US005269625A

United States Patent [19]

Stewart

[11] Patent Number: 5,269,625

[45] Date of Patent: Dec. 14, 1993

[54] ROCK DEPRESS FLOAT

[76] Inventor: Stanley R. Stewart, 1512 Knox, Springfield, Ill. 62703

[21] Appl. No.: 660,735

[22] Filed: Feb. 25, 1991

[51] Int. Cl.[5] ..... B05C 17/10; E01C 23/02; E01C 19/22

[52] U.S. Cl. ..... 404/97; 15/235.4; 404/107

[58] Field of Search ..... 404/97, 96, 107, 118; 15/120 A, 235.4, 235.5, 235.6, 235.7, 235.8

[56] References Cited

U.S. PATENT DOCUMENTS

| | | | |
|---|---|---|---|
| 2,410,343 | 10/1946 | Haivala | 15/235.6 |
| 2,578,163 | 7/1949 | Whalen | 15/235.6 |
| 3,053,311 | 7/1959 | Nottage | 15/235.5 |
| 3,665,820 | 5/1972 | Rasmussen | 404/107 X |
| 4,070,128 | 1/1978 | Garrison | 404/97 X |
| 4,397,581 | 8/1983 | Jarvis | 404/97 |
| 4,630,964 | 12/1986 | Allen | 404/96 |
| 4,723,869 | 2/1988 | Dragich | 404/97 |
| 4,954,010 | 9/1990 | Montgomery et al. | 404/96 |
| 4,958,399 | 9/1990 | Toal et al. | 15/235.4 X |

*Primary Examiner*—Ramon S. Britts
*Assistant Examiner*—Nancy P. Connolly

[57] ABSTRACT

A manually operated trowel is used for finishing wet concrete. The float portion is a rectangular plate-like structure with a handle mounted to its top center region. The handle may consist of several extensions. The base of the float has three distinct regions that extend along the length of the float. The front and rear regions are of a smooth texture while the center region, extending between the front and rear regions, has laterally extending teeth-like V-grooves. The grooves extend below the smooth surfaces of the forward and rearward regions.

4 Claims, 1 Drawing Sheet

ROCK DEPRESS FLOAT

BACKGROUND OF THE INVENTION

My invention relates to the improvement of a concrete float design for floating wet concrete.

PRIOR ART

It has been known that coarse aggregate will equal about 2/3 of ready-mix concrete. Sand and portland cement make up the last ⅓. After striking off or leveling out wet concrete between boards or forms, then starts a floating process. This involves the concrete worker' floating the top to bring sand and cement to the surface, while pushing the coarse aggregate down. This process provides a more durable, stronger, surface against weather conditions, salts, and thawing compounds. Also, this helps prevent the popping of rock which is caused by rock being too close to the top surface after concrete has hardened.

Other inventors have approached this problem with ideas such as U.S. Pat. No. 2,410,343 Haluala concrete float, filed in 1944. This float had steel blades for cutting below the top surface of concrete, but no smooth section for floating or filling voids made from its' steel blades. If the steel blades were spaced too far apart, this could roll the aggregate instead of pushing it down.

Another tool closely related is U.S. Pat. No. 4,070,128 Garrison tool. This tool is designed to put multiple grooves into finished concrete for traction purposes so the problem still exists. There is no tool being sold that can smooth the concrete surface while pushing the aggregate below the top surface.

SUMMARY OF THE INVENTION

The principal object of my invention is to provide a float that can be molded or extruded out of a single material, or made by using a material combination of wood, hardened plastics, magnezium, aluminum, or any lightweight material that would have a high resistance to wearing, bowing, or wrapping. It is also an object of the present invention to provide a float that will smooth the surface; while pushing across and pulling back, letting the teeth or V-grooves cut through the top surface of the concrete; pushing down the coarse aggregate, while the sand-cement mortar rises to the surface, filing voids and low spots, etc., then smoothing itself out by having the smooth sections on both ends of the V-grooves' section. This lets the float fill in the V-grooves' tracks when pushing or pulling over the surface of wet concrete. The more times the float is pushed and pulled, the deeper the aggregate is pushed down from the top. This allows the concrete workers to float and smooth the freshly poured concrete and push the aggregate down at the same time. This saves the worker time, makes the next steps easier, and provides a more durable top surface when completed.

If pouring a dry mix, for example: 2" slump, a D.C. battery-operated vibrator could be designed and attached to the rectangular body for more penetration on dryer surface pushing down the aggregate while bringing the sand-cement mortar to the top. This invention could also be perfected for hand-held floating devices.

DETAILED DESCRIPTION

Figure 1:
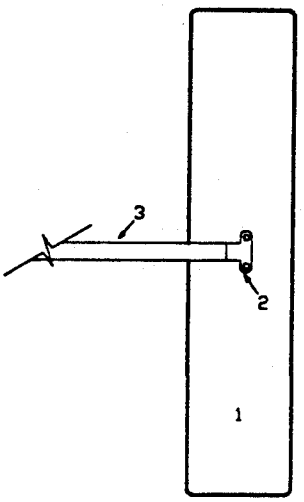
FIG. 1 is the top portion of a rectangular body of the invention with a handle-holding device bolted or welded in the center of the rectangular body, consisting of two detachable handles for illustration purposes.
Figure 2:
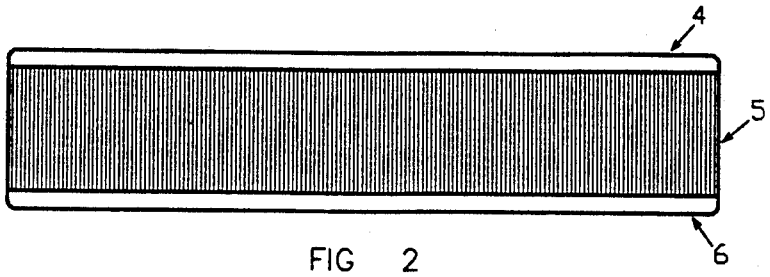
FIG. 2 is the bottom or working portion of the rectangular body shown in FIG. 1, also shows how V grooves are cut side by side through middle section and stops where smooth section begins.
Figure 3:
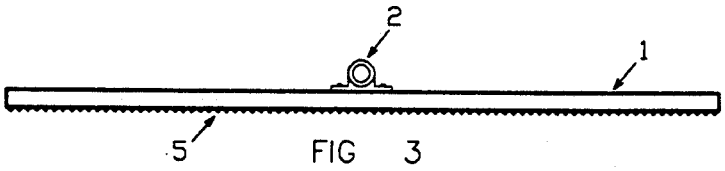
FIG. 3 is showing rear-view section and how the V grooves cut through the middle section.
Figure 4:
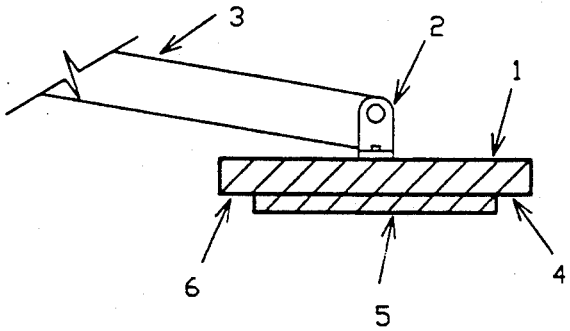
FIG. 4 is showing side view of rectangular body with lowered middle section.

The concrete finishing trowel is designed to depress larger aggregates and smooth over the concrete surface with a single tool. FIG. 1 shows the float and handle components of the invention. The float consists of a large rectangular body 1 that is molded or extruded out of a single material, or made by using a material combination of wood, hardened plastics, magnesium, aluminum, or any lightweight material that would have a high resistance to wearing, bowing, or warping. The float is relatively flat and approximately four feet in length and 9 inches in width. FIG. 2 shows the bottom surface of the float. There are three distinct regions on the bottom surface, each having significant width and each extending across the length of the float. The front edge region 4, extends from the front edge of the float to a center region. It has a smooth bottom surface for filling cracks and smoothing the wet concrete. The rear edge region 6 extends from the center region to the rear edge of the float. The surface of the rear edge region is the same texture and height as that of the front edge region. The center edge region 5 is textured with widthwise extending parallel V-grooves that are evenly spaced in a close formation. The grooves are V-shaped and parallel in order to prevent aggregate particles from getting caught therebetween and are close together in order to insure that large particles of the aggregate are contacted and forced down into the concrete mixture beneath the surface. The grooves extend below the smooth bottom surfaces of edge regions 4 and 6.

A manipulating handle 3 is mounted to the center of the top of the rectangular float 1 with a handle mounting means 2. The handle can be one piece or may be a combination of extensions that render the handle longer in the event that a longer region of concrete is to be finished. This feature is shown in FIG. 1.

In use, the handle 3 should be kept low with reference to the ground so that the front smooth edge 4 is tilted up and off of the concrete surface. The teeth like grooves of center region 5 will then cut into the top surface of the wet concrete and force the aggregate downward. Simultaneously, the trailing smooth rear edge 6 will fill the tracks left by the V-grooves with the sand cement mortar that makes up the concrete. Upon pulling back on the handle and lifting it high with reference to the ground, the rectangular float should be angled so that the rear smooth edge 6 will now be above the concrete surface. The teeth like grooves of center region 5 will then cut into the top surface of the wet concrete and force the aggregate downward. Simultaneously, the now trailing smooth front edge 4 will fill the tracks left by the V-grooves with the sand-cement mortar that makes up the concrete.

I claim:

1. A manually operated float for finishing concrete comprising;

a detachable handle device secured on top of and in the center of a solid, rectangularly-shaped float having a front edge region, a center region and a rear edge region on its bottom surface;

wherein the front region extends from a front edge of the float to the center region, the center region extends from the front edge region tot he rear edge region and the rear edge region extends from the center region to a rear edge of the float;

and said front and rear edge regions each extend at least two inches from the front and rear edges, respectively, of the float and are smooth on the bottom;

and wherein said center region features V-grooves cut parallel to one another in an evenly and closely spaced arrangement, laterally across the width of said center region and extending below the smooth bottom surfaces of the front and rear regions.

2. A manually operated float for finishing concrete as in claim 1 wherein the rectangular float dimensions are approximately 4 feet in length and 9 inches in width.

3. A manually operated float for finishing concrete as in claim 1 wherein the handle means includes one or more elongate extensions to lengthen the handle in order to allow operation over a greater distance.

4. A manually operated float for finishing concrete as in claim 2 wherein the handle means includes one or more elongate extensions to lengthen the handle in order to allow operation over a greater distance.

* * * * *